US010549148B2

(12) United States Patent
Hsu

(10) Patent No.: US 10,549,148 B2
(45) Date of Patent: Feb. 4, 2020

(54) EXERCISE DEVICE

(71) Applicant: Cheng-Yang Hsu, Changhua (TW)

(72) Inventor: Cheng-Yang Hsu, Changhua (TW)

( * ) Notice: Subject to any disclaimer, the term of this patent is extended or adjusted under 35 U.S.C. 154(b) by 65 days.

(21) Appl. No.: 16/006,542

(22) Filed: Jun. 12, 2018

(65) Prior Publication Data

US 2019/0054345 A1 Feb. 21, 2019

(30) Foreign Application Priority Data

Aug. 17, 2017 (TW) ..... 106212174 U

(51) Int. Cl.

| | |
|---|---|
| ***A63B 22/06*** | (2006.01) |
| ***A63B 21/00*** | (2006.01) |
| ***A63B 24/00*** | (2006.01) |
| ***A63B 71/06*** | (2006.01) |

(52) U.S. Cl.

CPC ..... *A63B 22/0605* (2013.01); *A63B 21/4034* (2015.10); *A63B 21/4035* (2015.10); *A63B 24/0087* (2013.01); *A63B 71/0622* (2013.01); *A63B 2022/0647* (2013.01); *A63B 2071/0658* (2013.01); *A63B 2210/50* (2013.01); *A63B 2225/093* (2013.01)

(58) Field of Classification Search

None

See application file for complete search history.

(56) References Cited

U.S. PATENT DOCUMENTS

| | | | | |
|---|---|---|---|---|
| 5,044,627 | A * | 9/1991 | Huang | A63B 22/0002 482/115 |
| 5,178,593 | A * | 1/1993 | Roberts | A63B 23/03516 482/56 |
| 5,269,736 | A * | 12/1993 | Roberts | A63B 23/03516 482/51 |
| 5,342,262 | A * | 8/1994 | Hansen | A63B 22/0012 482/51 |
| 5,947,874 | A * | 9/1999 | Dougherty | A63B 22/0002 482/52 |
| 10,039,951 | B2 * | 8/2018 | Chang | A63B 21/4034 |
| 10,052,516 | B1 * | 8/2018 | Lin | A63B 22/001 |
| 2008/0303243 | A1 * | 12/2008 | Ying | B62K 15/008 280/287 |

* cited by examiner

*Primary Examiner* — Stephen R Crow

(57) ABSTRACT

An exercise device has a main rod, a connecting unit, and a sub rod. The connecting unit has a first plate and a second plate, and the first plate and the second plate are both provided with an axial hole and a rotating axis. The first plate has an arced slot, and the second plate has a closing aperture, a first positioning aperture, a second positioning aperture and a third positioning aperture. The sub rod has a through aperture and a connecting aperture at an end, and the through aperture is inserted with the rotating axis. Another end of the sub rod has a front stand and a control member disposed in the connecting aperture of the sub rod. One end of the control member passes through the arced slot of the first plate to form a pull knob, another end of the control member has an inserting pin.

6 Claims, 7 Drawing Sheets

EXERCISE DEVICE

BACKGROUND OF INVENTION

1. Field of Invention

The present invention relates to an exercise device, and more particularly to a stand-up exercise device.

2. Description of Related Art

Due to the busy schedule of modern life, resulting in irregular lifestyles and diets, and lack of exercise. In order to overcome the limitations of time and weather, there are many exercise devices available on the market. Taking a treadmill as an example, there are mainly treadmill devices provide two pedals for the user to use. However, it is not difficult to see the above-mentioned conventional structure having some deficiencies, and the main reasons are as follows: the simple type of treadmill has the advantage of small size, but it has low functionality and no hand grip, therefore, during the stepping process, the user must also pay attention to physical balance, and is only suitable for low-speed pedaling. The effect of fitness exercises is limited.

Therefore, it is desirable to provide a stand-up exercise device to mitigate and/or obviate the aforementioned problems.

SUMMARY OF INVENTION

An objective of present invention is to provide a floor mat puzzle having a non-rectangular isometric polygonal mat, which is capable of improving the above-mention problems.

In order to achieve the above mentioned objective, an exercise device has a main rod, a connecting unit, and a sub rod. The main rod has a rear stand at one end and a pair of handles on another end, the main rod is provided with a spinning unit. Each side of the spinning unit respectively is connected with a pedal, and the pedals driving the spinning unit. The connecting unit is fixed onto the main rod between the handle and the spinning unit. The connecting unit has a first plate and a second plate parallel with each other, and the first plate and the second plate are both provided with an axial hole and a rotating axis. The first plate has an arced slot equi-spaced from the axial hole, and the second plate has a closing aperture, a first positioning aperture, a second positioning aperture and a third positioning aperture corresponding to the arced slot. The closing aperture is disposed adjacent to the main rod, and the first positioning aperture, the second positioning aperture and the third positioning aperture are disposed sequentially away from the main rod. The sub rod has a through aperture and a connecting aperture at an end and inserted between the first plate and the second plate of the connecting unit, and the through aperture is inserted with the rotating axis. Another end of the sub rod has a front stand and a control member disposed in the connecting aperture of the sub rod. One end of the control member passes through the arced slot of the first plate to form a pull knob, another end of the control member has an inserting pin, and the pull knob is capable of driving the inserting pin to insert into the closing aperture or into the first positioning aperture, the second positioning aperture, or the third positioning aperture.

Other objects, advantages, and novel features of invention will become more apparent from the following detailed description when taken in conjunction with the accompanying drawings.

DETAILED DESCRIPTION OF PREFERRED EMBODIMENT

Figure 1:
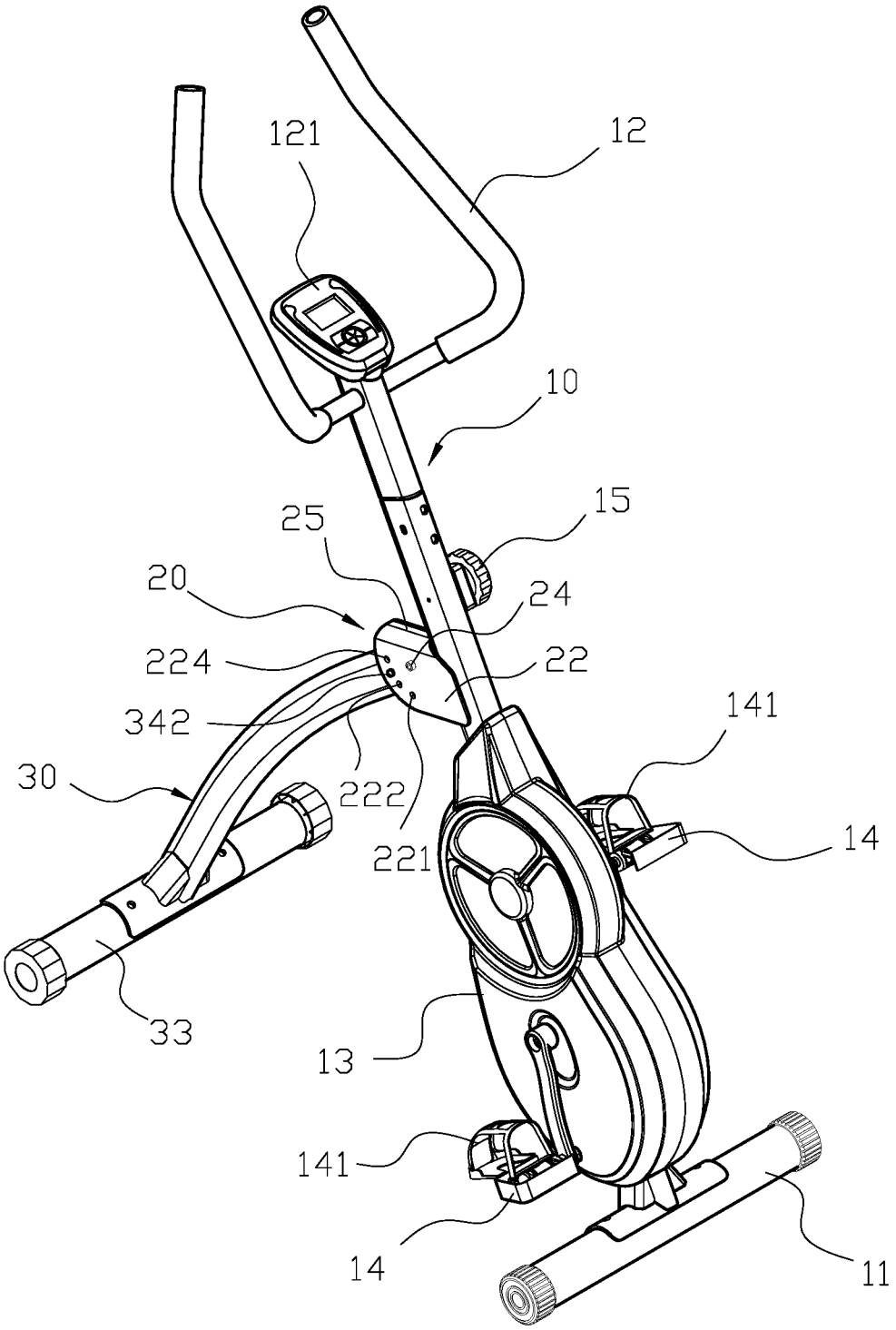
FIG. 1 is a perspective view of a preferred embodiment of the present invention.
Figure 2:
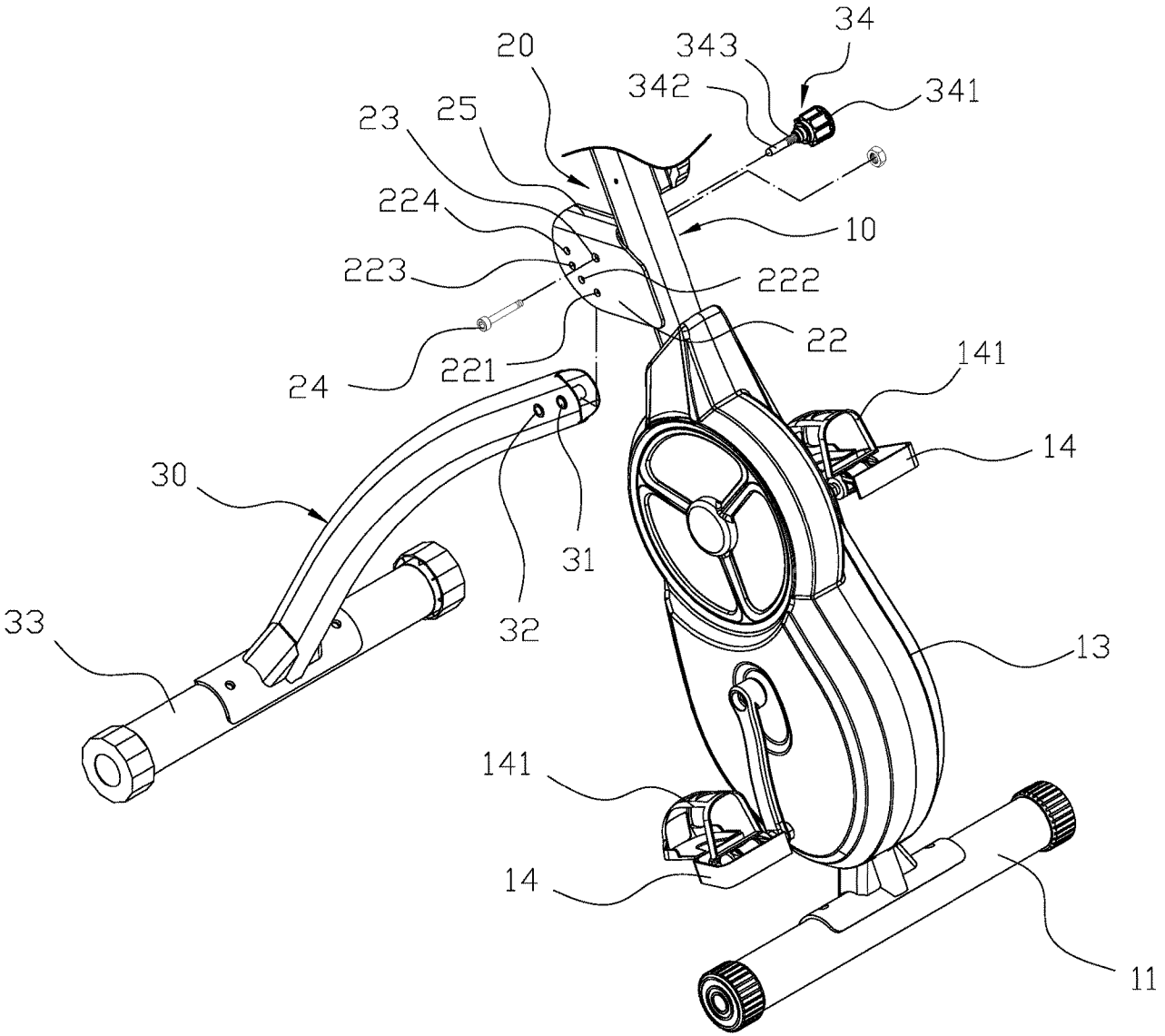
FIG. 2 is an exploded perspective view of the first perspective view of the preferred embodiment of the present invention.
Figure 3:
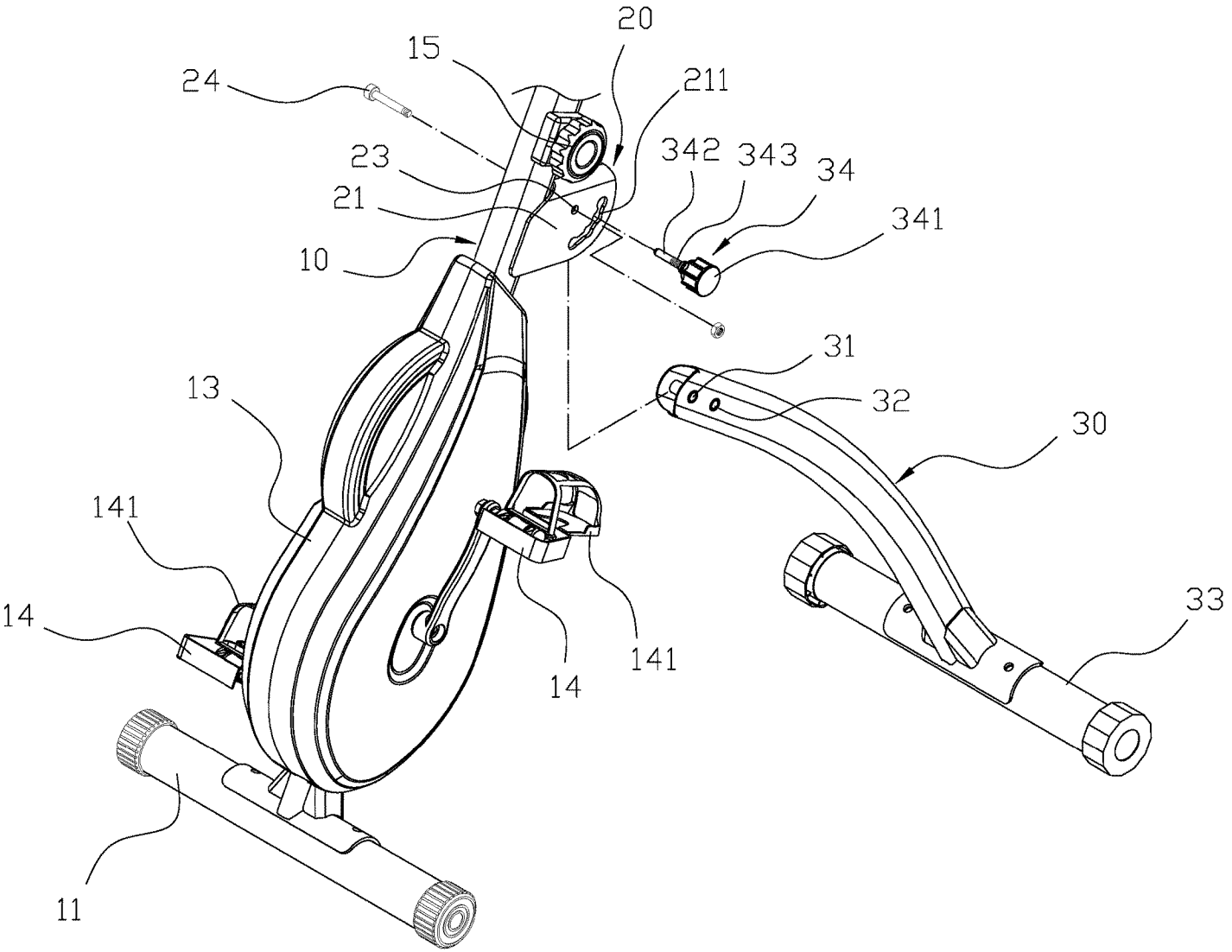
FIG. 3 is an exploded perspective view of the second perspective view of the preferred embodiment of the present invention.

Please refer to FIGS. 1, 2 and 3. An exercise device comprises: a main rod 10, a connecting unit 20 and a sub rod 30. The main rod 10 has a rear stand 11 at one end and a pair of handles 12 on another end. The main rod 10 further comprises a display 121 on the handles 12. The main rod 10 is further provided with a spinning unit 13, each side of the spinning unit 13 is respectively connected with a pedal 14, and the pedals 14 drive the spinning unit 13. The two pedals 14 of the spinning unit 13 respectively have a foot loop 141 for holding user's foot. The main rod 10 further comprises an adjusting button 15, and the adjusting button 15 controls resistance while the pedals 14 drive the spinning unit 13. The connecting unit 20 is fixed onto the main rod 10 between the handle 12 and the spinning unit 13, and the connecting unit 20 has a first plate 21 and a second plate 22 parallel with each other. The first plate 21 and the second plate 22 are both provided with an axial hole 23 and a rotating axis 24. The first plate 21 has an arced slot 211 equi-spaced from the axial hole 23, and the second plate 22 has a closing aperture 221, a first positioning aperture 222, a second positioning aperture 223 and a third positioning aperture 224 corresponding to the arced slot 211. The closing aperture 221 is disposed adjacent to the main rod 10, and the first positioning aperture 222, the second positioning aperture 223 and the third positioning aperture 224 are disposed sequentially away from the main rod 10. The sub rod 30 *a* through aperture 31 and a connecting aperture 32 at an end and is inserted between the first plate 21 and the second plate 22 of the connecting unit 20, and the through aperture 31 is inserted into the rotating axis 24. Another end of the sub rod 30 has a front stand 33 and a control member 34 is disposed in the connecting aperture 32 of the sub rod 30. One end of the control member 34 passing through the arced slot 211 of the first plate 21 to form a pull knob 341, and another end of the control member 34 has an inserting pin 342. The control member 34 further has a threaded section 343 between the pull knob 341 and the inserting pin 342, for engaging with the connecting aperture 32 of the sub rod 30. The pull knob 341 is capable of driving the inserting pin 342 to insert into the closing aperture 221 for closing the main rod 10 and the sub rod 30 together. The pull knob 341 drives the inserting pin 342 to be inserted into the first positioning aperture 222, the second positioning aperture 223, or the third positioning aperture 224. Furthermore, the connecting unit 20 is connected to a stopping panel 25 between the first plate 21 and the second plate 22, and the stopping panel 25 stops the sub rod 30 to provide support when the inserting pin 342 inserts into the third positioning aperture 224.

Figure 4:
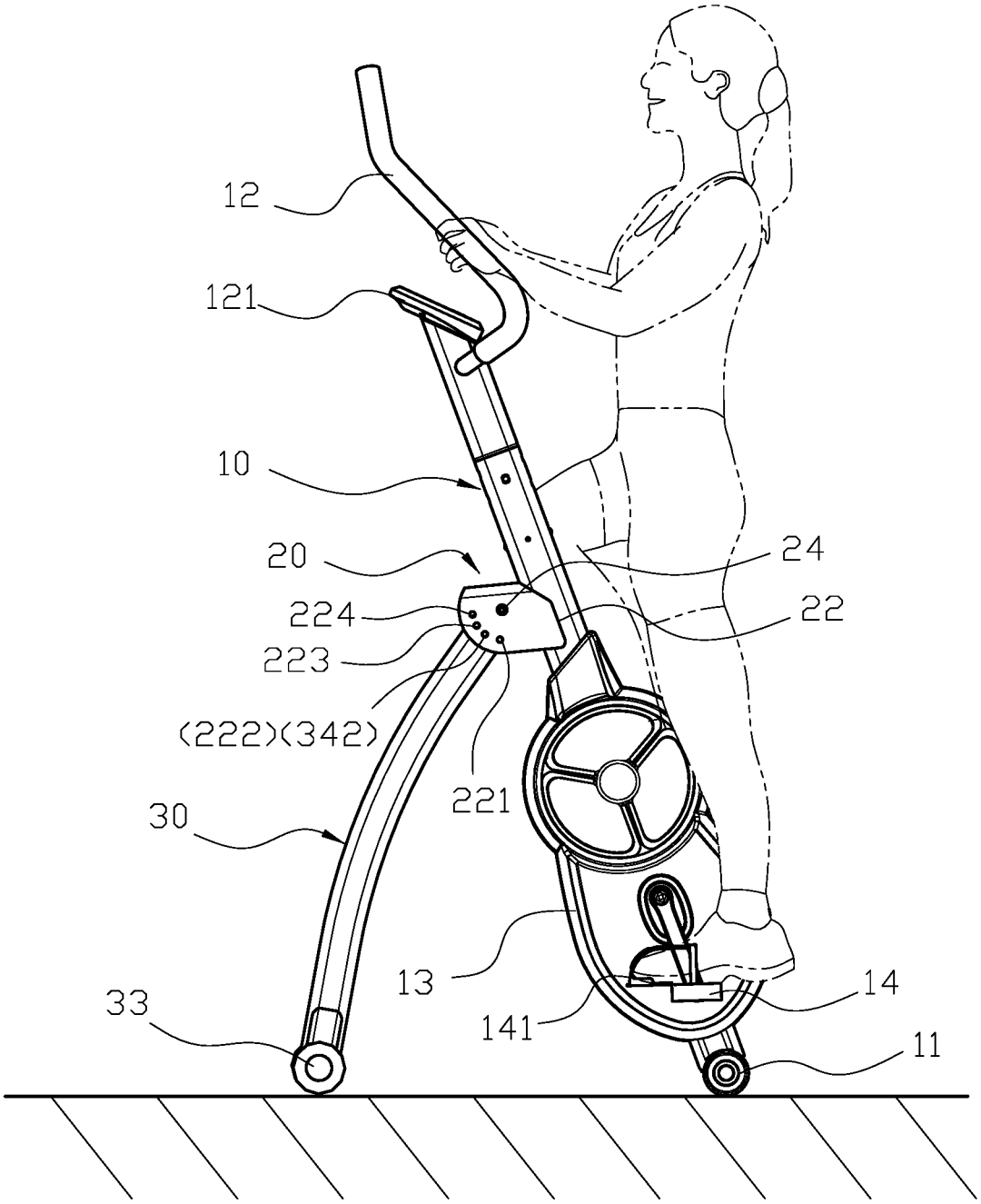
FIG. 4 is a schematic drawing of the lightweight use state of the preferred embodiment of the present invention.
Figure 5:
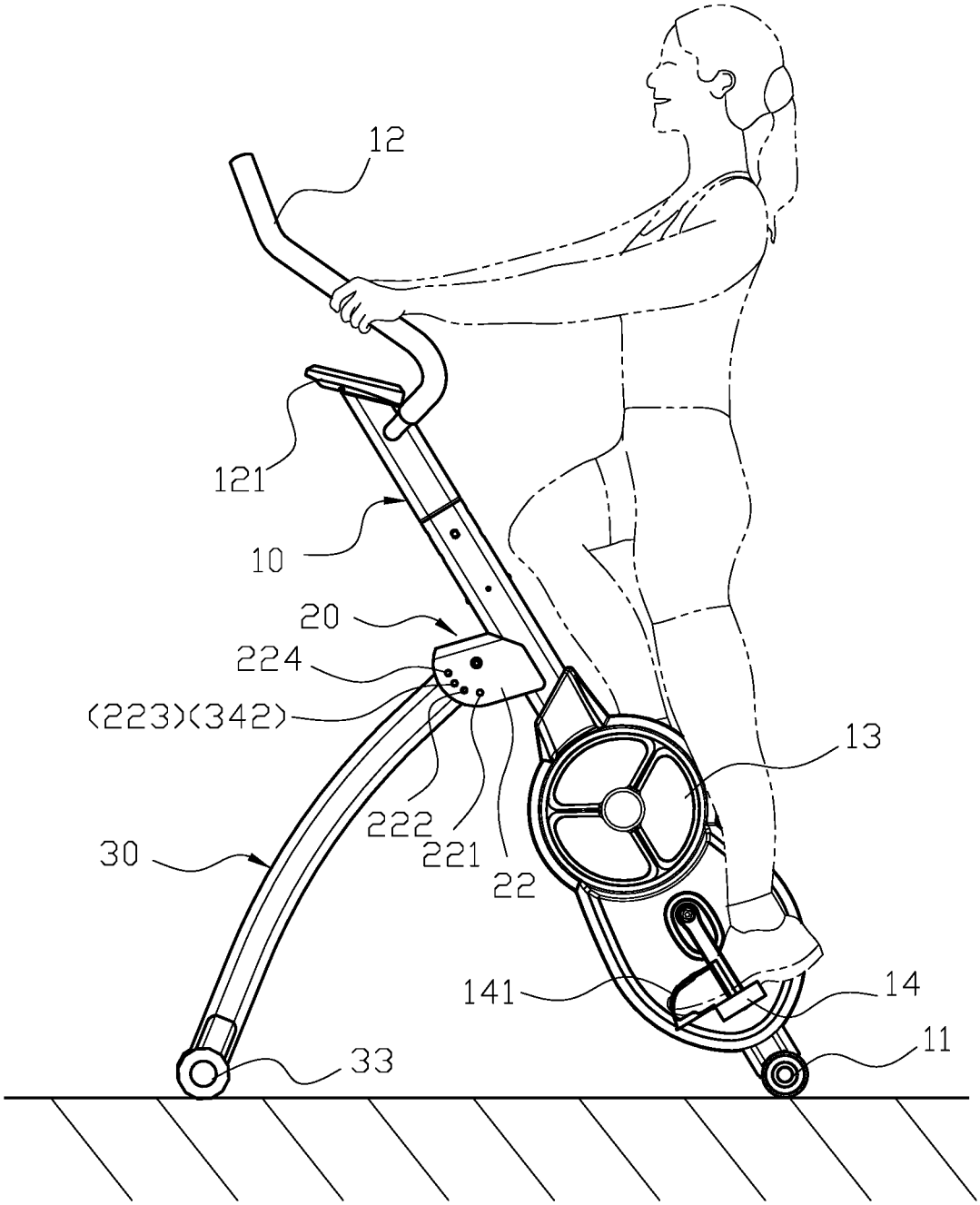
FIG. 5 is a schematic drawing of the state of use of the preferred embodiment of the present invention.
Figure 6:
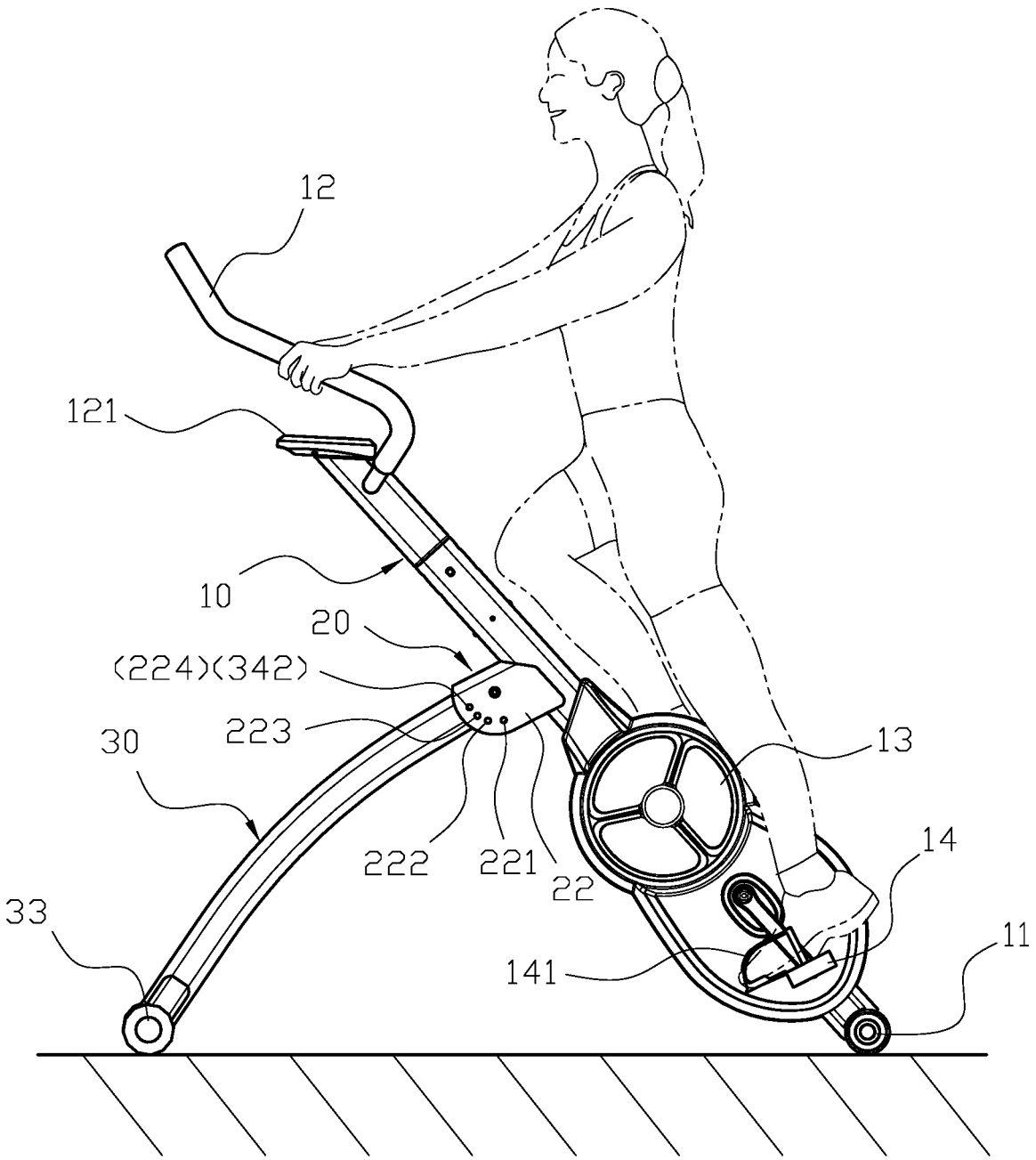
FIG. 6 is another schematic drawing of the state of use of the preferred embodiment of the present invention.
Figure 7:
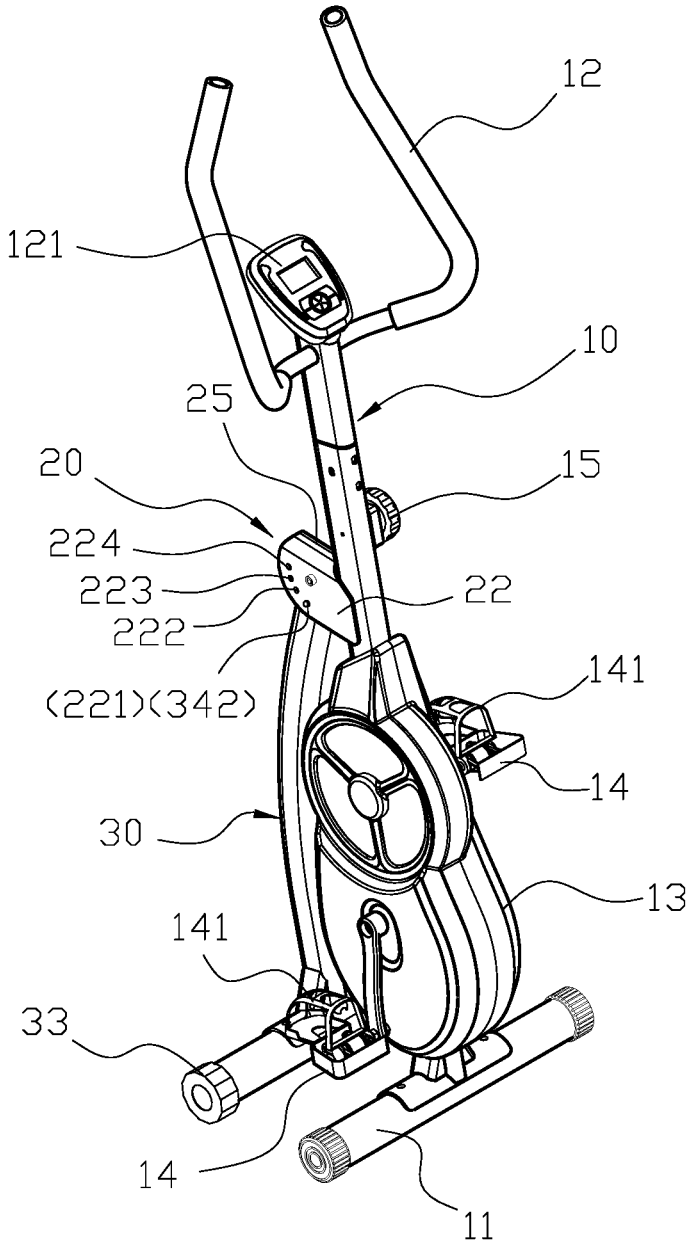
FIG. 7 is a schematic drawing of the storage state of the preferred embodiment of the present invention.

For actual operation, please refer to FIGS. 1, 2 and 3. The spinning unit 13 is disposed at the main rod 10 near the rear stand 11, and the connecting unit 20 is fixed at the main rod 10 positioned between the spinning unit 13 and the handle 12. One end of the sub rod 30 is inserted between the first plate 21 and the second plate 22 of the connecting unit 20, the rotating axis 24 is placed through the axial hole 23 and the through aperture 31, and the sub rod 30 is pivoted with the connecting unit 20. So the main rod 10 and the sub rod 30 can form a stable standing in the shape of a herringbone with the rear stand 11 and the front stand 33. The control member 34 is locked at the connecting aperture 32 of the sub rod 30 with the threaded section 343 and provides the pull knob 341 passing through the arced slot 211 of the first plate 21 and the inserting pin 342 of the control member 34 inserts into the second plate 22. When a light weight fitness exercise is desired, referring again to FIG. 4, the user can pull the pull knob 341 of the control member 34 to move the inserting pin 342 out of the closing aperture 221, which allows the control member 34 to slide along the arced slot 211 of the connecting unit 20. The sub rod 30 swings around the rotating axis 24 and the inserting pin 342 is directly inserted into the first positioning aperture 222, thereby completing the adjustment of the relative angle between the main rod 10 and the sub rod 30. The relative angle between the main rod 10 and the sub rod 30 is approximately 60 degrees, the user can stand on the pedal 14 with both foot and hold both hands at the handle 12 in a vertical standing state, and he or she can use the loop 141 to trap the feet to prevent from falling off. In this case, the fitness exercise mode is low difficulty, and the body weight is concentrated on the foot. When a middle-level fitness exercise is desired, please referring to FIG. 5. The pull knob 341 is pulled to separate the inserting pin 342 from the second positioning 22 of the second plate 22 (also to separate the closing aperture from passing through 224), which allows the adjustment of the position of the sub rod 30 relative to the second positioning aperture 223 and stabilizes the combination of the control member 34 and the connecting unit 20. Now, the main rod 10 and the sub rod 30 are apart in a relative angle of about 80 degrees, which allows the user to stand on the pedal 14 and hold the handle 12 to form a posture in which the upper body leans forward while still exerting force on both hands and waist. In this way, it increases the difficulty of the exercise and requires to use the other muscles on user's feet to strengthen the fitness process. Moreover, when a heavy weight exercise is in desire, please refer to FIG. 6. The inserting pin 342 of the control member 34 is inserted into the third positioning aperture 224 to form a relative angle 100 degrees between the main rod 10 and the sub rod 30. With the included angle, the handle 12 is leaned forward more, the user's body can move forward further, thereby increasing the difficulty and effect of the movement through the support of the waist, back, and hands. The device is quite suitable for a high-speed stepping exercise. In summary, the fitness device can provide different degrees of difficulty, so as to improve its applicability and strengthen the fitness effect, and it also easy to adjust among different fitness modes. In addition, as shown in FIG. 7, when the device is intended to be stored, the sub rod 30 rests on the side of the spinning unit 13, the inserting pin 342 is inserted into the closing aperture 221 to form a folded position, which can quickly reduce its size so as to achieve easy storage.

Although the present invention has been explained in relation to its preferred embodiment, it is to be understood that many other possible modifications and variations can be made without departing from the spirit and scope of invention as hereinafter claimed.

What is claimed is:

1. An exercise device comprising:

a main rod having a rear stand at one end and a pair of handles on another end, the main rod provided with a spinning unit, each side of the spinning unit respectively connected with a pedal, and the pedals driving the spinning unit;

a connecting unit fixed onto the main rod between the handle and the spinning unit, the connecting unit having a first plate and a second plate parallel with each other, the first plate and the second plate both provided with an axial hole and a rotating axis; the first plate having an arced slot equi-spaced from the axial hole, the second plate having a closing aperture, a first positioning aperture, a second positioning aperture and a third positioning aperture corresponding to the arced slot, the closing aperture disposed adjacent to the main rod, and the first positioning aperture, the second positioning aperture and the third positioning aperture disposed sequentially away from the main rod; and a sub rod having a through aperture and a connecting aperture at an end and inserted between the first plate and the second plate of the connecting unit, the through aperture is inserted into the rotating axis; another end of the sub rod having a front stand and a control member disposed in the connecting aperture of the sub rod, one end of the control member passing through the arced slot of the first plate to form a pull knob, another end of the control member having an inserting pin, and the pull knob capable of driving the inserting pin to insert into the closing aperture or into the first positioning aperture, the second positioning aperture, or the third positioning aperture.

2. The exercise device as claimed in claim 1, wherein the connecting unit is connected to a stopping panel between the first plate and the second plate, and the stopping panel stops the sub rod to provide support when the inserting pin inserts into the third positioning aperture.

3. The exercise device as claimed in claim 1, wherein the control member has a threaded section between the pull knob and the inserting pin, for engaging with the connecting aperture of the sub rod.

4. The exercise device as claimed in claim 1, wherein the two pedals of the spinning unit respectively have a foot loop.

5. The exercise device as claimed in claim 1, wherein the main rod further comprises an adjusting button, and the adjusting button controls resistance while the pedals drive the spinning unit.

6. The exercise device as claimed in claim 1, wherein the main rod further comprises a display on the handle.

* * * * *